US005667007A

United States Patent [19]

Nishishita

[11] Patent Number: 5,667,007

[45] Date of Patent: Sep. 16, 1997

[54] LAMINATED HEAT EXCHANGER

[75] Inventor: Kunihiko Nishishita, Konan, Japan

[73] Assignee: Zexel Corporation, Tokyo, Japan

[21] Appl. No.: 623,935

[22] Filed: Mar. 28, 1996

[30] Foreign Application Priority Data

Mar. 30, 1995 [JP] Japan ..... 7-97790

[51] Int. Cl.[6] ..... F28D 1/03

[52] U.S. Cl. ..... 165/153; 165/176; 165/DIG. 466

[58] Field of Search ..... 165/153, 176; 62/515

[56] References Cited

U.S. PATENT DOCUMENTS

| | | | |
|---|---|---|---|
| 5,158,135 | 10/1992 | Nagasaka | 165/153 |
| 5,370,176 | 12/1994 | Nishishita et al. | 165/153 X |
| 5,553,664 | 9/1996 | Nishishita et al. | 165/153 |

FOREIGN PATENT DOCUMENTS

| | | | |
|---|---|---|---|
| 129270 | 6/1991 | Japan | 62/515 |
| 194001 | 7/1994 | Japan | 62/515 |

*Primary Examiner*—Leonard R. Leo

*Attorney, Agent, or Firm*—Wenderoth Lind & Ponack

[57] ABSTRACT

A laminated heat exchanger in which tube elements and end plates can be bonded without forming gaps is provided while an end structure provides a sufficient flow passage area through the tube elements at the ends. An outside formed plate forming a tube element at one end of a laminated heat exchanger is formed flat and an end plate is bonded to the flat formed plate. The formed plate is provided with indentations and projections corresponding to those in the flat formed plate to which it is bonded face-to-face, and portions where the flat formed plate comes into contact with the end plate are formed flat or planar. The bonding margins of the end plate where it contacts the flat formed plate are formed so as to avoid areas which include indentations and projections in the flat formed plate. The end plate is formed so as to cover the entire surface of the flat formed plate.

15 Claims, 8 Drawing Sheets

LAMINATED HEAT EXCHANGER

BACKGROUND OF THE INVENTION

1. Field of the Invention

The present invention relates to a laminated heat exchanger constructed by laminating tube elements alternately with fins. The laminated heat exchanger is used for air conditioning systems for vehicles, residential facilities and the like.

2. Description of the Related Art

Laminated heat exchangers in the known art include those formed by laminating tube elements, each of which is provided with tank portions and a passage communicating with the tank portions over a plurality of levels. Fins are provided between the tube elements, and adjacent tube elements are bonded at the tank portions so that they communicate in the direction of the lamination. End plates are provided on the outside of the tube elements at the ends of the assembly.

In such a laminated heat exchanger, the tube elements at the ends may each be formed by bonding a formed plate, provided with distended portions for tank formation and a distended portion for passage formation, to a flat formed plate. However, if a flat formed plate is employed, there is a problem in that the passage cross section will be small, and in order to prevent this, it is desirable to have indentations and projections on the surface of the flat plate which correspond to those on the surface of the formed plate to which it is to be bonded face-to-face. In other words, it is desirable to form distended portions in the flat formed plate where such plate faces opposite the distended portions for tank formation and the distended portion for passage formation of the formed plate to which the flat formed plate is to be bonded face-to-face. It is also desirable to form beads and the like on the flat formed plate, similar to those formed in the distended portion for passage formation.

However, as shown in FIG. 8, even if an end plate B is mounted to a flat formed plate A, provided with indentations and projections on the surface formed with beads or the like, it does not necessarily mean that complete surface-to-surface bonding can be achieved. Also, if the end plate is placed in contact so as to block some of the indented portions C, it will result in a reduction of bonding surface area. Also, unless the end plate B and the flat formed plate A are bonded over a specific area, they may become deformed during assembly with the use of jigs or in the finished product due to insufficient bonding strength. Furthermore, if a gap is formed between any of the indented portions C and the end plate B, water D may collect in the gap, and this water D will freeze and expand repeatedly, resulting in cracking of the flat formed plate A and thereby creating a coolant leak.

SUMMARY OF THE INVENTION

Addressing the problems described above, the object of the present invention is to provide a laminated heat exchanger in which, even when flat formed plates are used for the tube elements at the ends, a sufficient passage area is assured through the tube element and the end plate is bonded without gaps so as to improve the strength of the bonds, and to ensure that water does not collect between the flat formed plate and the end plate, and thus preventing the formed plates from becoming damaged.

Accordingly, the laminated heat exchanger according to the present invention includes a tube element assembly which is formed by laminating a plurality of tube elements, each of which is formed by bonding a pair of formed plates face-to-face alternately with fins over a plurality of levels. The tube elements at the end of the tube assembly are constituted by bonding a flat formed plate on the outside with an end plate. The flat formed plate may be provided with indentations and projections on its surface which correspond to those on the formed plate to which it is to be bonded face-to-face. Also, the area of the flat formed plate where it comes into contact with the end plate is formed flat or planar.

In this laminated heat exchanger, the end plate may be formed with a shape which projects outwardly toward the flat formed plate so as to contact or bond with the flat formed plate. The bonding area excludes the portion which opposes the portion of the surface of the flat formed plate having the indentations and projections. The end plate may be provided to cover the entire surface of the flat formed plate.

Consequently, since the flat formed plate may be provided with indentations and projections on its surface in correspondence with those in the formed plate to which it is to be bonded face-to-face, a large passage area is assured even for the tube elements at the ends. In addition, since the flat formed plate has indentations and projections, gaps could be formed between the formed plate and the end plate to which it is bonded, and thus such gaps may become a cause for concern. However, since the end plate is placed in contact with only flat portions of the flat formed plate, bonding is achieved without gaps over this flat area, an the object described above is achieved.

BRIEF DESCRIPTION OF THE DRAWINGS

The above and other features of the invention and the advantages associated therewith will be better understood and appreciated by persons skilled in the field to which the invention pertains in view of the following description in conjunction with the accompanying drawings which illustrate the embodiments. In the drawings.

DETAILED DESCRIPTION OF THE PREFERRED EMBODIMENTS

The following is an explanation of the embodiments of the present invention in reference to the drawings.

Figure 1A:
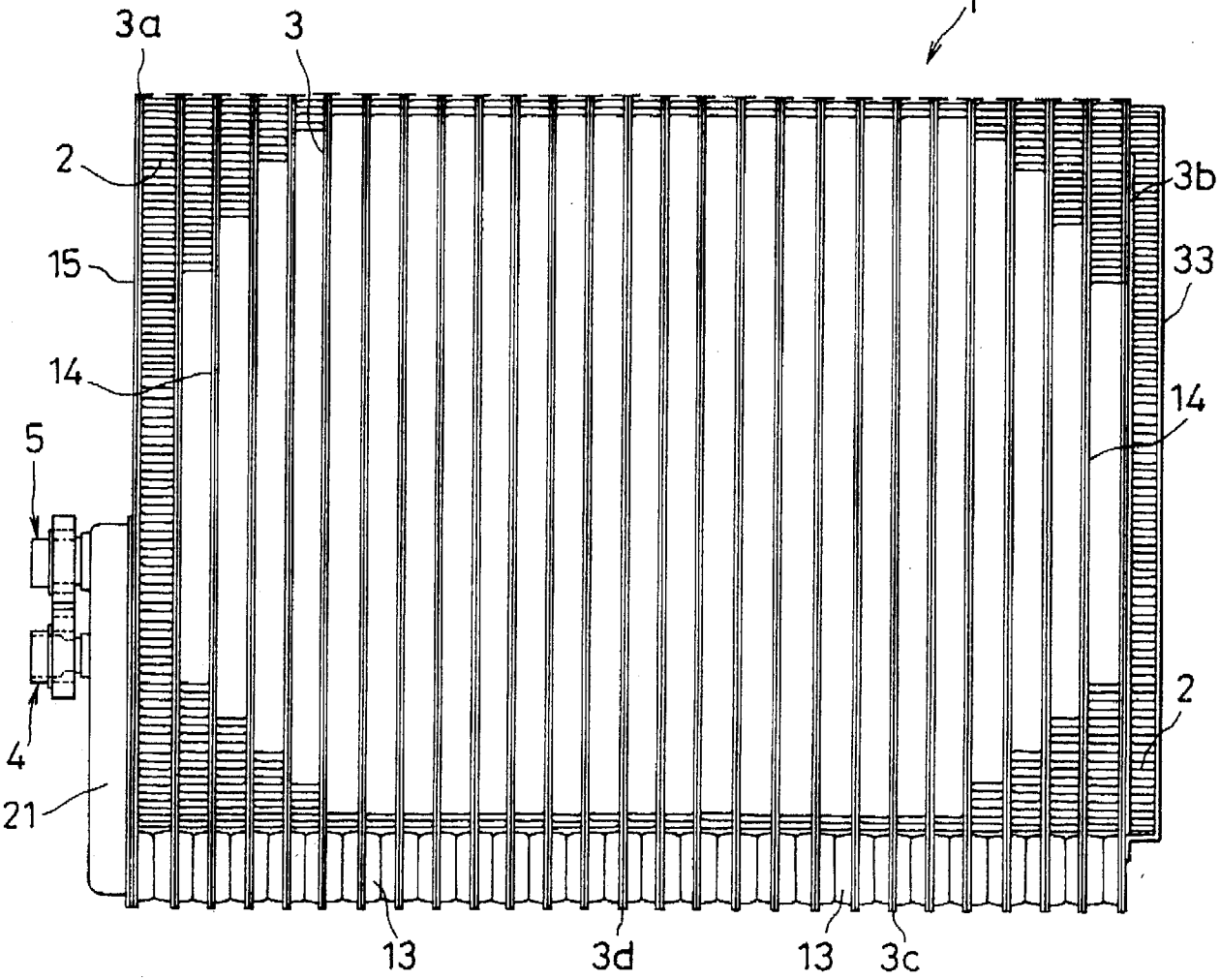
FIG. 1A shows a front view of a laminated heat exchanger according to the present invention.
Figure 1B:
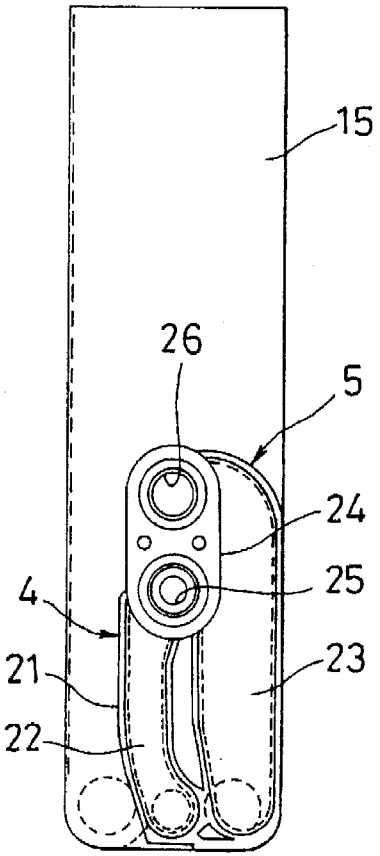
FIG. 1B shows a side view illustrating the intake portion and the outlet portion of a first heat exchanging core portion.
Figure 2:
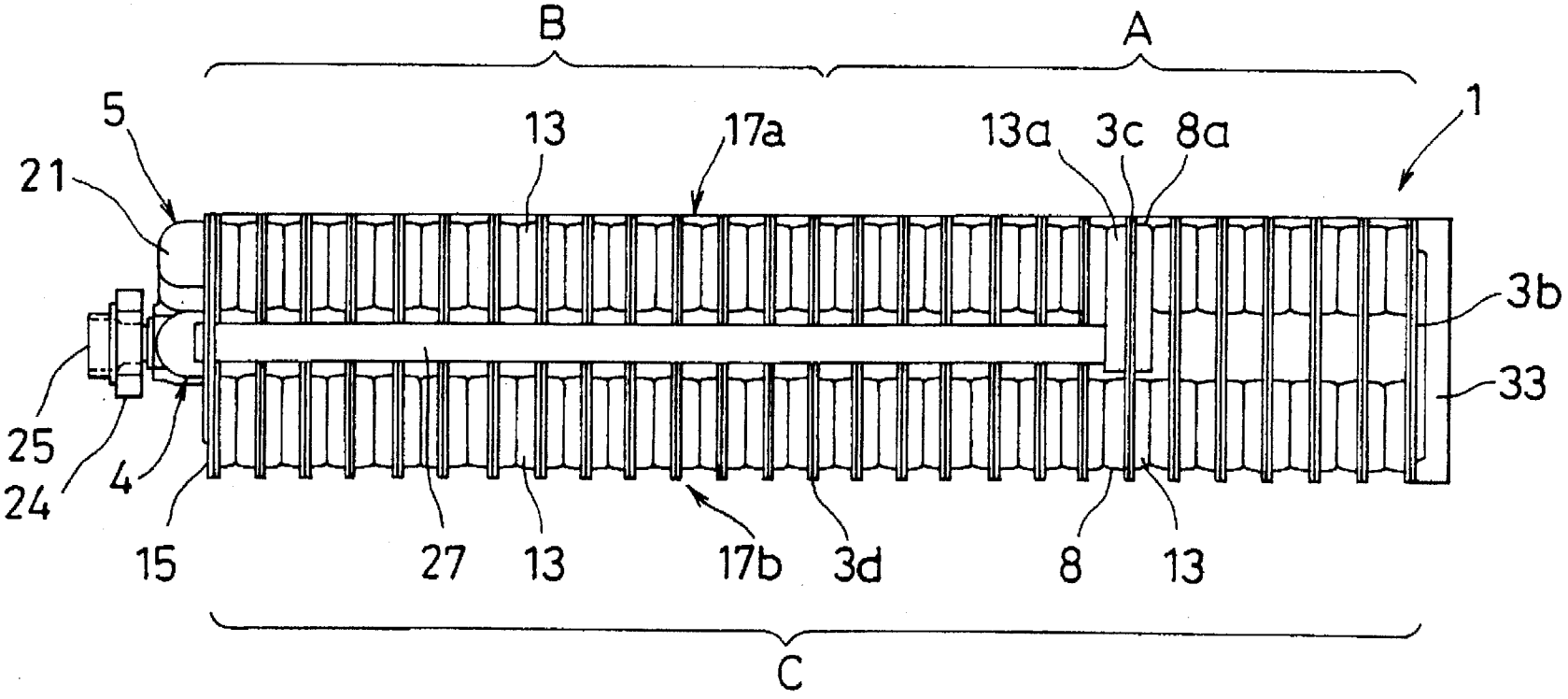
FIG. 2 shows the bottom view of the laminated heat exchanger shown in FIG. 1.
Figure 3A:
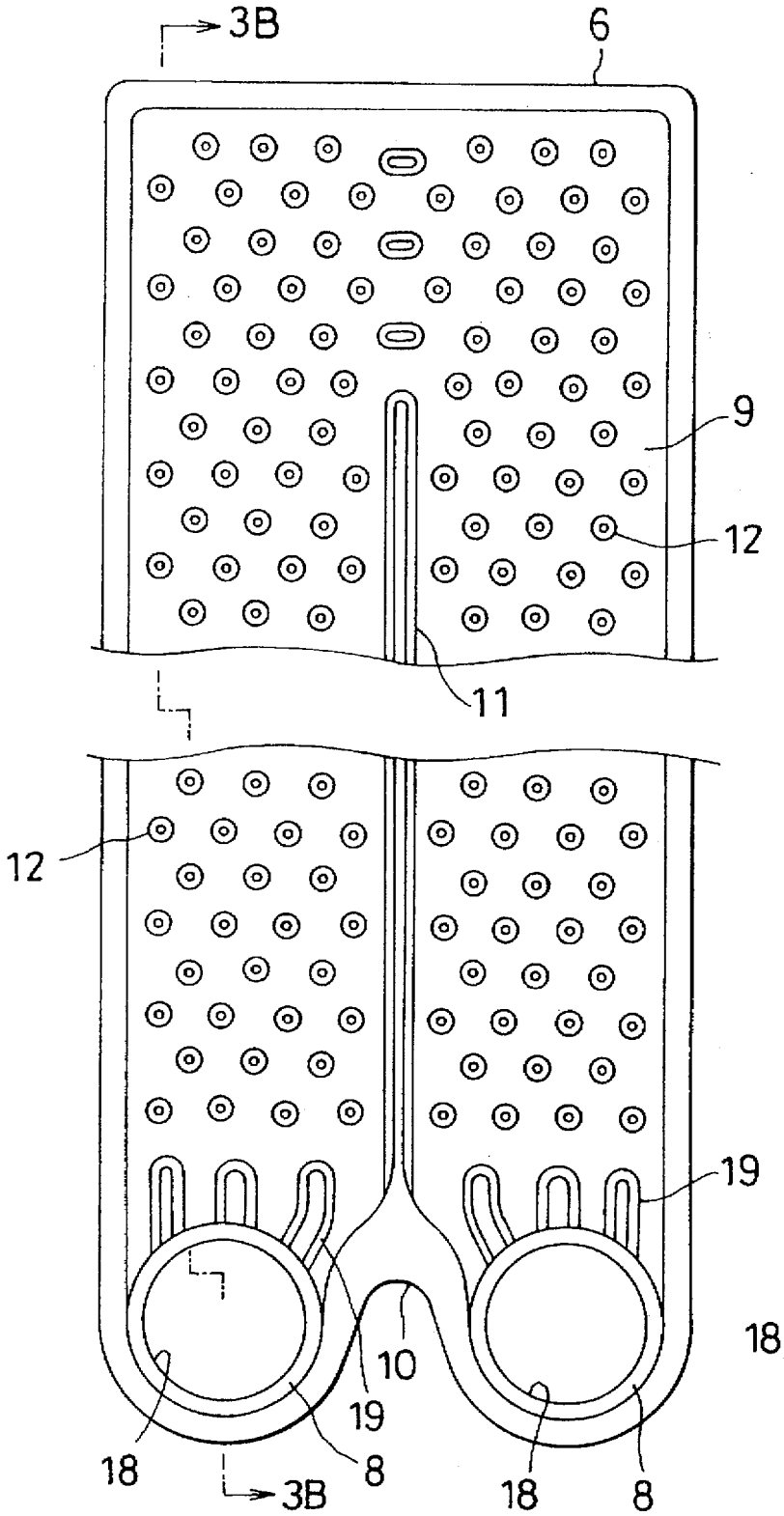
FIG. 3A shows a front view of a formed plate employed in the laminated heat exchanger shown in FIG. 1.
Figure 3B:
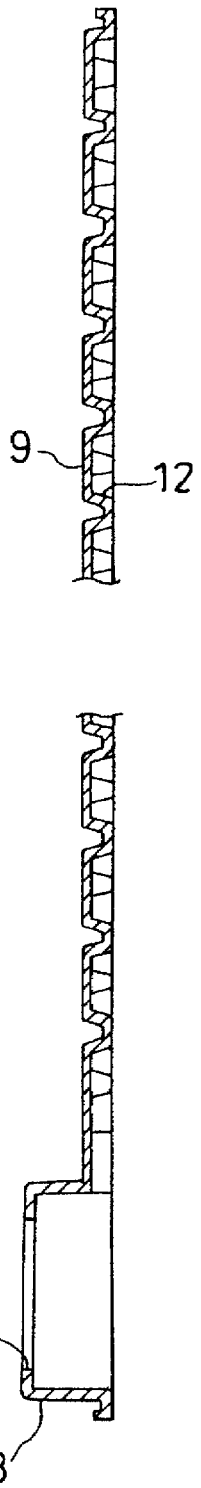
FIG. 3B shows a cross section of FIG. 3A taken along line 3B—3B.

In FIGS. 1A, 1B and 2, a 4-pass type laminated heat exchanger 1 is illustrated. The heat exchanger 1 includes a core main body which is formed by laminating fins 2 and tube elements 3 alternately over a plurality of levels. Also, an intake portion 4 and an outlet portion 5 for heat exchanging medium are provided at the tube element 3 positioned at one end in the direction of lamination. The tube elements 3 are each constituted by bonding two formed plates 6, one of which is shown in FIGS. 3A and 3B, except for tube elements 3*a* and 3*b* at the two ends of the core main body in the direction of the lamination, the tube element 3*c* which is provided with an expanded tank portion, which is to be explained later, and a tube element 3*d* which is located near the center of the tube assembly.

The formed plate 6 is formed by press machining an aluminum plate. The plate 6 includes two bowl-like distended portions for tank formation 8 at one end, a distended portion for passage formation 9, and an indented portion 10 for mounting a communicating pipe, which will be explained later, between the distended portions for tank formation. Also, a projection 11, extending from the area between the two distended portions for tank formation 8 to the vicinity of the other end of the formed plate 6, is formed in the distended portion for passage formation 9.

The distended portions for tank formation 8 distend out in the direction of lamination more than the distended portion for passage formation 9. The projection 11 is formed in the same plane as the bonding margin along the edge of the formed plate. Consequently, when two formed plates 6 are bonded at their edges, the projections 11 become bonded as well, and a pair of tank portions 13 are formed by the distended portions for tank formation 8 which oppose each other, while a U-shaped passage portion 14 communicating between the tank portions 13 is formed by the distended portions for passage formation 9 which oppose each other.

Tube elements 3*a* and 3*b* are positioned at opposite ends in the direction of the lamination. The tube element 3*a* is formed by bonding a flat formed plate 15 without any indentations and projections on its surface with a formed plate 6, shown in FIGS. 3A and 3B. The other tube element 3*b* is formed by bonding a flat formed plate 16, shown in FIGS. 4A and 4B, with a formed plate 6, shown in FIGS. 3A and 3B.

The tube element 3*c* is formed by bonding face-to-face formed plates each with one distended portion for tank formation 8*a* expanded in the direction of the other distended portion for tank formation 8. Thus, the tube element 3*c* is different from the other tube elements 3 in that it is provided with a tank portion 13, the size of which is the same as that of the tank portions formed in the other tube elements 3 and a tank portion 13*a* which is expanded or increased in size so as to fill the indented portion.

As shown in FIG. 1A and FIG. 2, in the laminated heat exchanger 1, adjacent tube elements abut with each other at their tank portions and the abutted tank portions constitute a first tank group 17*a* and a second tank group 17*b* in the direction of the lamination (the direction which runs at a right angle to the direction of the air flow), with all of the tank portions in the first tank group 17*a*, which includes the expanded tank portion 13*a*, in communication via through holes 18 formed in the distended portions for tank formation except at the tube element 3*d*, which is positioned near the center of the tube element assembly.

As for the tube element 3*d*, it is formed by bonding face-to-face a formed plate 6, shown in FIGS. 3A and 3B, with a formed plate having an identical shape but with no through hole formed in one of the distended portions for tank formation. This tube element 3*d* partitions the first tank group 17*a* into a first tank block A, which includes the expanded tank portion 13*a*, and a second tank block B, which communicates with the outlet portion 5. In addition, all of the tank portions in the second tank group 17*b* are in communication via through holes 18 without any partitioning, to constitute a third tank block C.

The intake portion 4 and the outlet portion 5 are formed by bonding an intake/outlet passage plate 21 to the flat plate 15 and are provided with an intake passage 22 and an outlet passage 23 respectively, which extend from approximately the middle in the direction of the length of the flat plate 15 towards the tank portions.

In the upper portion of the intake passage 22 and the outlet passage 23, an inflow port 25 and an outflow port 26 respectively are provided via a coupler 24 for securing an expansion valve. The intake passage 22 and the enlarged tank portion 13*a* communicate with each other through a communicating passage defined by a communicating pipe 27 which is secured in the indented portion 10. The second tank block B and the outlet passage 23 communicate with each other via a hole formed in the plate 15.

Thus, heat exchanging medium which has flowed in from the intake portion 4 travels through the communicating pipe 27 and enters the enlarged tank portion 13*a*. The fluid is then dispersed throughout the entirety of the first tank block A, and travels upwardly through the U-shaped passage portions 14 of the tube elements which correspond to the first tank block A along the projections 11 (first pass). The fluid then makes a U-turn above the projections 11 to travel downward (second pass), and flow into the tank group on the opposite side (third tank block C). After that, the heat exchanging medium travels horizontally to the remaining tube elements constituting the third tank block C, and travels upwardly through the U-shaped passage portions 14 along the projections 11 (third pass). Then, the fluid makes a U-turn above the projections 11 before traveling downward (fourth pass) into the tank portions constituting the second tank block B. The fluid then flows out through the outlet portion 5. The heat of the heat exchanging medium is communicating to the fins 2 during the process in which the heat exchanging medium flows through the U-shaped passage portions 14 constituting the first through fourth passes, so that heat exchange can be performed with air passing between the fins.

Figure 4A:
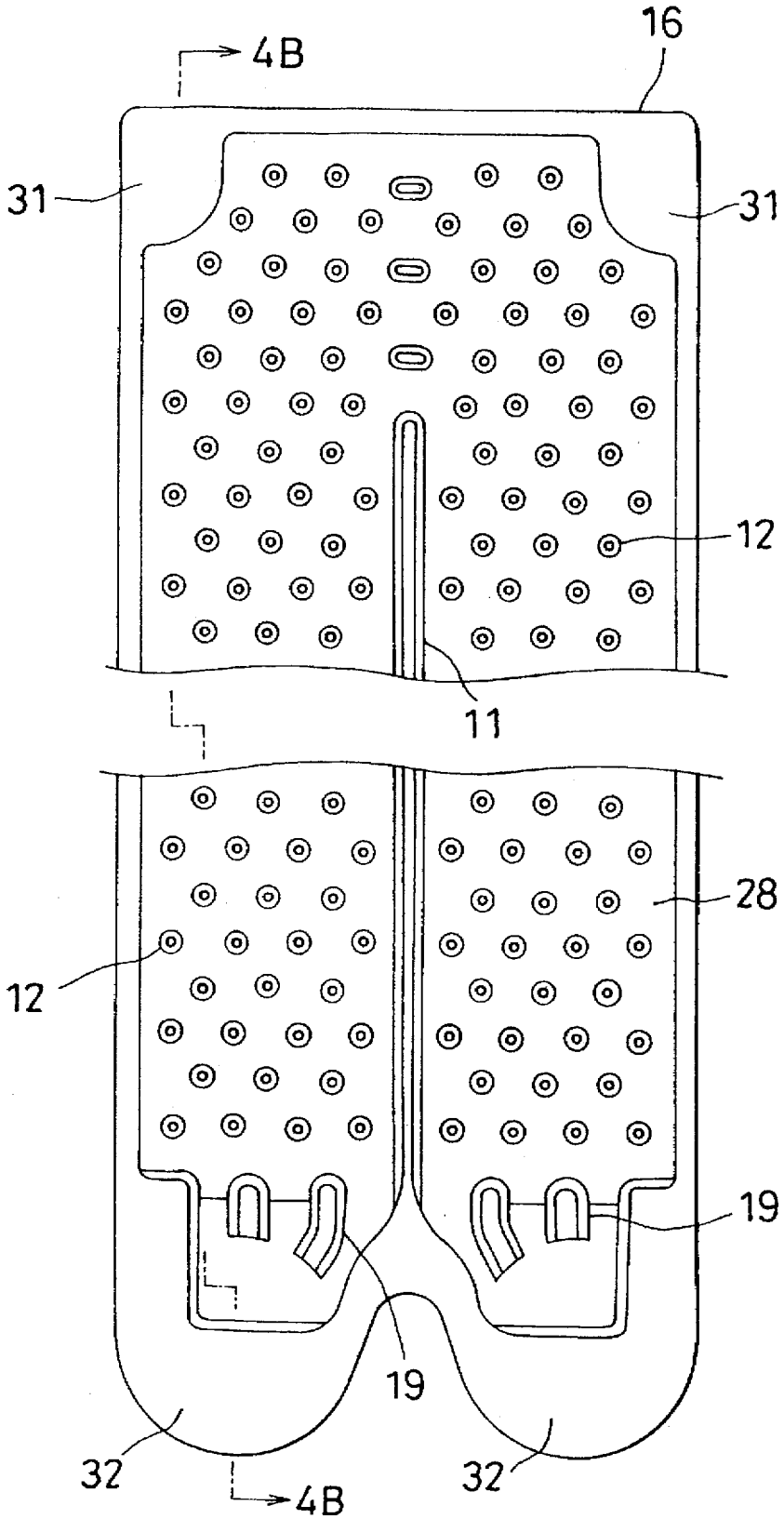
FIG. 4A shows a front view of a flat formed plate employed in an end tube element.
Figure 4B:
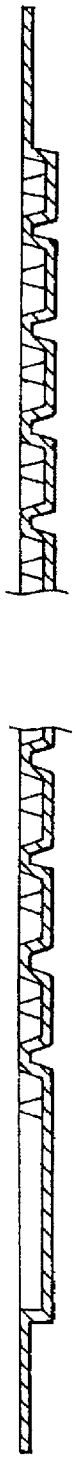
FIG. 4B shows a cross section of FIG. 4A taken along line 4B—4B.

As shown in FIGS. 4A and 4B, while the external shape of the flat formed plate 16 used for the tube element 3*b* is identical to that of the formed plate 6 shown in FIG. 3A, the portion which corresponds to the distended portion for passage formation 9 of the formed plate 6 is also distended to the same degree. Also, beads 12 and projection 11 are formed identically to the beads 12 and the projection 11 of the formed plate 6. Distended portions 28 formed in the flat formed plate 16 extend so as to oppose the distended portions for tank formation 8 of the formed plate 6 and are provided with shoal-like beads 19 as in the case of the formed plate 6.

Figure 6A:
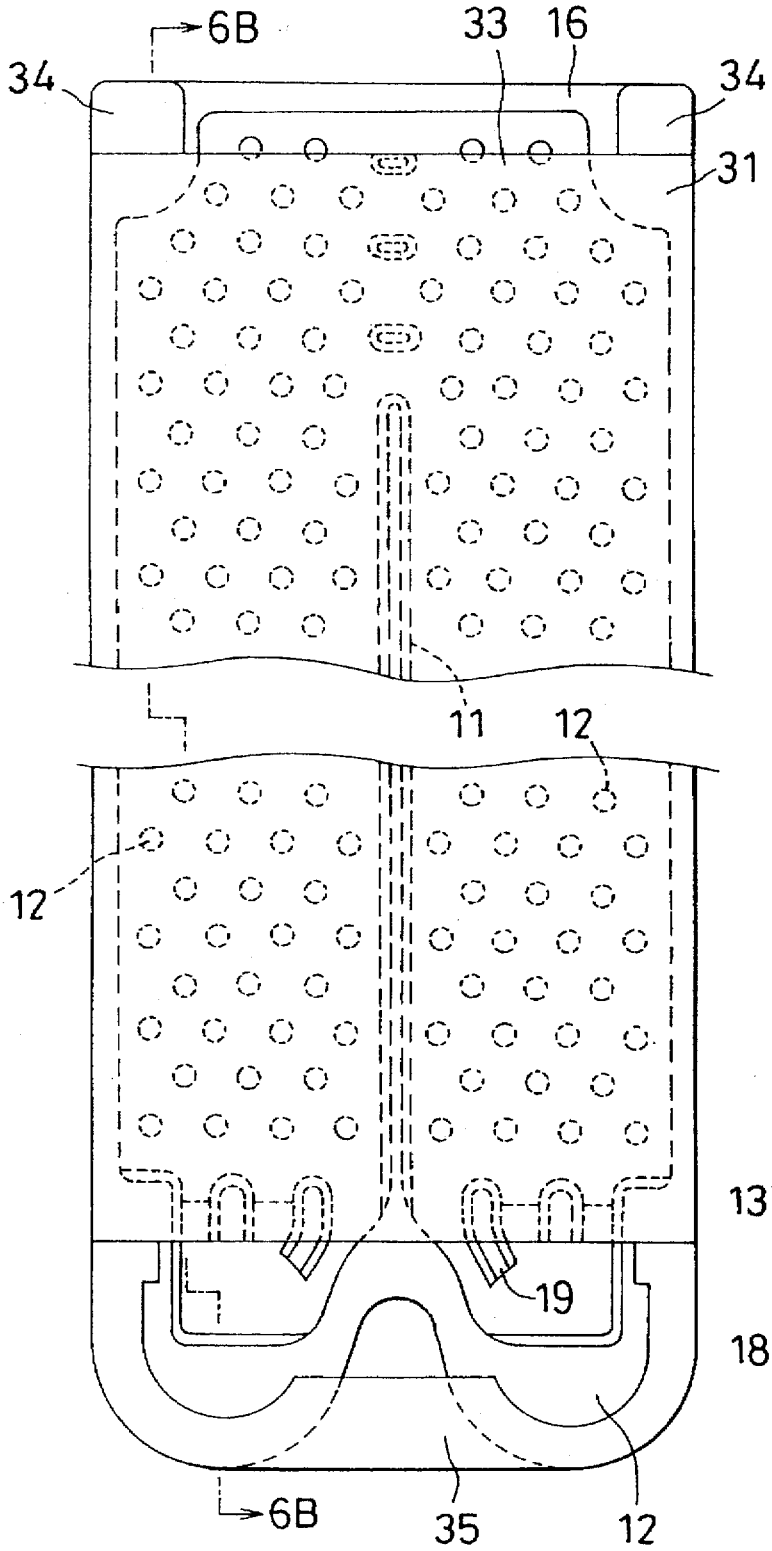
FIG. 6A shows a side view of a state in which a tube element at an end is bonded with an end plate.
Figure 6B:
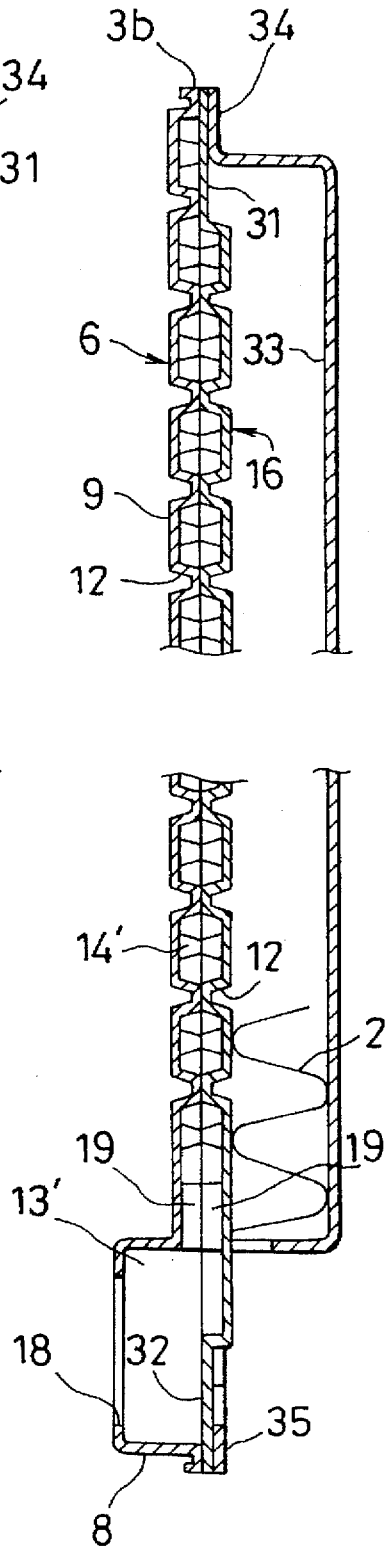
FIG. 6B shows a cross section of FIG. 6A taken along line 6B—6B.

In addition, flat areas 31, 31 and 32, 32, which are not distended are formed in the upper corners and the lower ends respectively of the flat formed plate 16. As a result, when the flat formed plate 16 and the formed plate 6 are bonded face-to-face, almost a lower half of the tank portion 13' and the upper corners of the U-shaped passage portion 14' are narrowed with the flat areas 31 and 32, as shown in FIG. 6B.

Figure 5A:
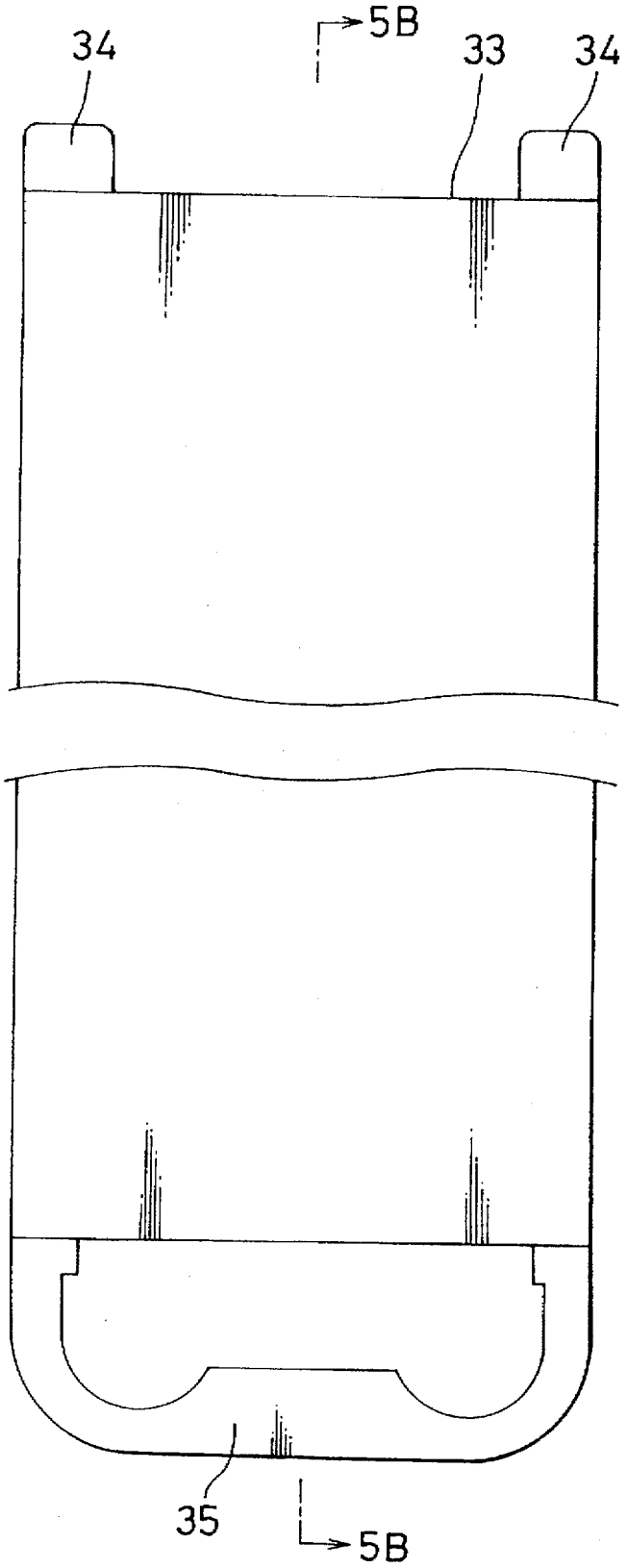
FIG. 5A shows a front view of an end plate.
Figure 5B:
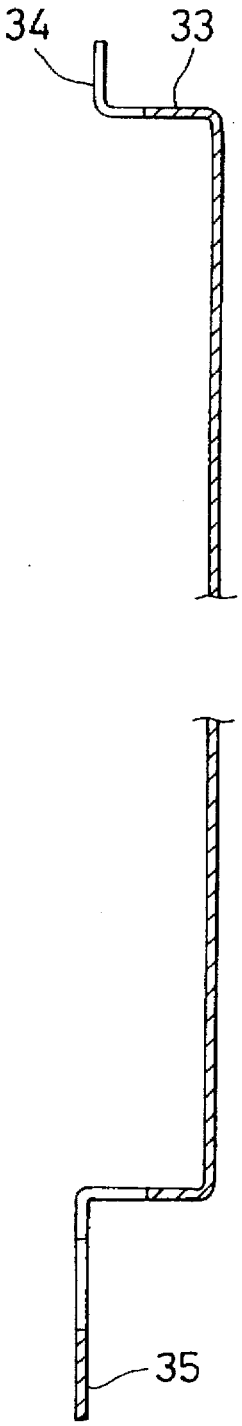
FIG. 5B shows a cross section of FIG. 5A taken along line 5B—5B.

As for the end plate 33, it is mounted to the tube element 3*b* at the end by bonding it to the flat formed plate 16 at the upper and lower portions with a fin 2 provided between the flat formed plate 16 and the end plate 33. To give a more detailed explanation of the end plate 33, as shown in FIGS. 5A and 5B, its upper and lower ends are bent toward the flat formed plate to form lower end bonding margins 35 and upper end bonding margins 34. The bonding margins 34 are placed in contact with only the flat areas 31 formed at the upper corners of the flat formed plate 16, while the bonding margin 35 is placed in contact with only the flat portions 32 formed at the lower end.

In other words, the bonding margins 34 formed at the upper end of the end plate 33 are formed at opposite sides of the upper end and their upper ends are aligned to the upper end of the formed plate 16 with a portion between the two bonding margins 34 removed, so that it will not interfere with the indentations and projections of the formed plate 16 which extends away from the surface of the formed plate 16. Also, the bonding margin 35, formed at the lower end of the end plate 33, forms an approximate U-shape overall, with the portion bent toward the flat formed plate gouged out or shaped so that it will not interfere with the indentations and projections of the formed plate 16. The lower end of end plate 33 is aligned with the lower end of the formed plate 16 so that they are in contact within the range of the flat areas 32. Note that the flat areas 31 and 32 are formed larger than the bonding margins of the end plate to allow for misalignment during assembly.

In the structure described above, the heat exchanger 1 is completed by placing a formed plate 6 which is clad on both surfaces, in contact with a flat formed plate 16, which is also clad on both surfaces, placing the flat formed plate 16 in contact with an end plate 33 which is clad only on the side facing the flat formed plate 16 (clad on one surface) via the fins 2 and securing the entire assembly along with other members and brazing the assembly in a furnace.

With this, the formed plate shown in FIGS. 3A and 3B and the formed plate shown in FIGS. 4A and 4B are bonded face-to-face so as to form the tube element **3*b* at one end and the end plate 33 shown in FIGS. 5A and 5B is bonded to the flat formed plate 16 so that the passage area, which is approximately equal to that in the other tube elements, is assured, even in the tube element 3*b* located at the end of the tube element assembly. Although the passage areas in the upper corners and the lower end of the tube element 3*b* are somewhat smaller because of the flat areas 31 and 32 of the formed plate 16**, the ratio of those areas against the entire passage area is quite small and this does not affect the overall flow situation as far as passage resistance is concerned.

Moreover, since the flat formed plate 16 and the end plate 33 are bonded only in the flat areas 31 and 32 of the flat formed plate 16, the bonding can be implemented without creating any gaps, eliminating the likelihood of water entering in between the bonding areas and, thus, it is possible to provide a laminated heat exchanger with a high degree of strength and outstanding durability.

Figure 7A:
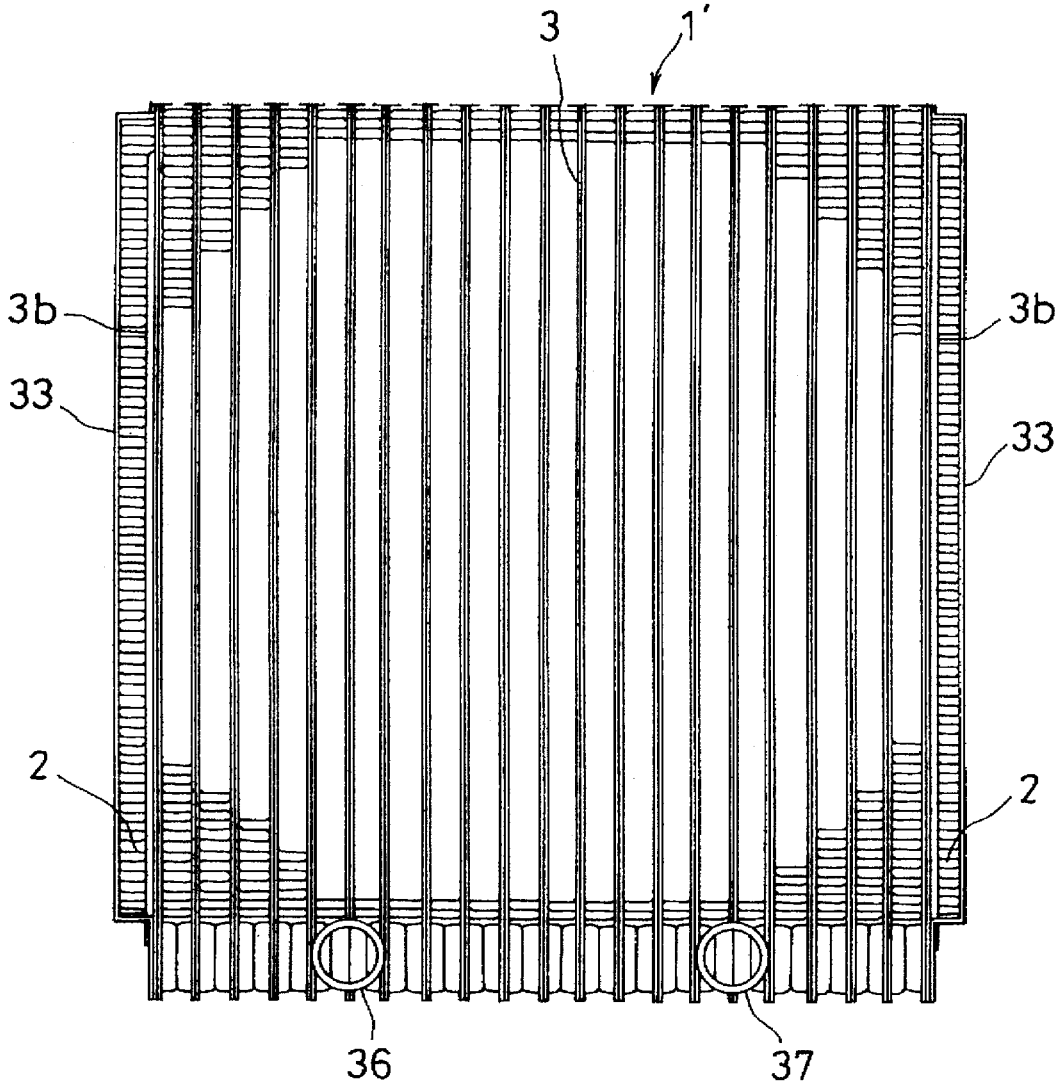
FIG. 7A shows a front view of another laminated heat exchanger according to the present invention.
Figure 7B:
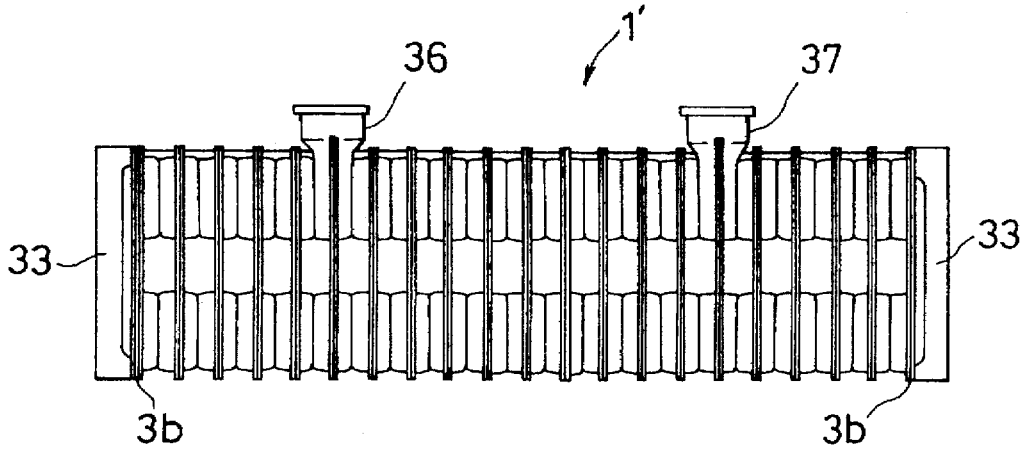
FIG. 7B shows a bottom view.
Figure 8:
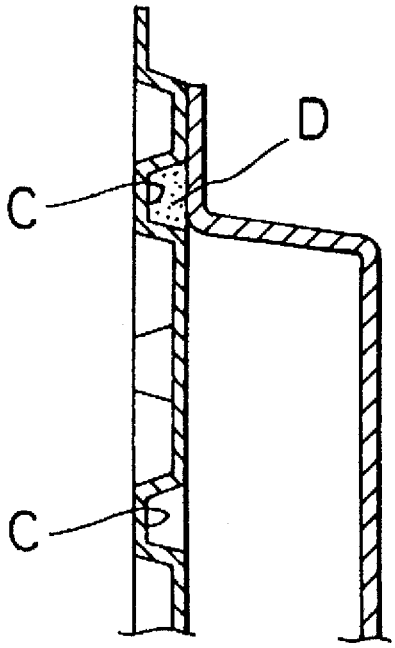
FIG. 8 PRIOR ART
FIG. 8 illustrates problems arising in the prior art when a flat formed plate A and an end plate B are bonded.
Figure 8:
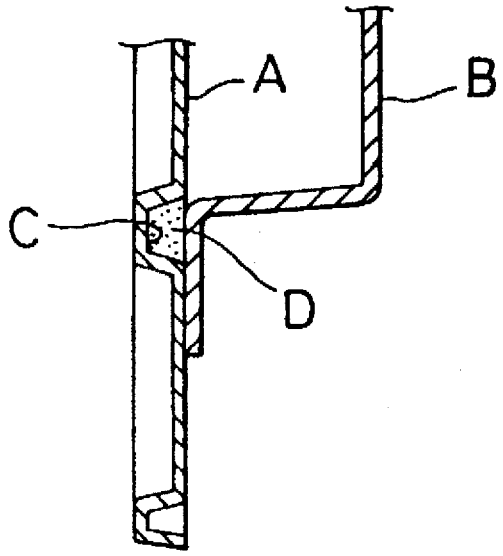
FIG. 8 PRIOR ART

In addition, since the end plate 33 is provided so as to cover the entire surface of the flat formed plate 16, during assembly, a jig will be applied from the outside of the end plate where the brazing material is not clad. As a result, brazing material will not adhere to the jig during brazing, making it possible to prevent degradation of the jig. Note that the structure employed at the ends described above can be adopted at the two ends of known laminated heat exchangers, i.e., a laminated heat exchanger with a structure similar to that shown in FIGS. 7A and 7B, in which the core main body is formed by laminating fins 2 and tubes 3 alternately over a plurality of levels. The heat exchanger also includes an intake portion 36 and an outlet portion 37 for heat exchanging medium and are formed as part of the tank portions of the tube elements at the upstream side or the downstream side in the direction of the air flow. It goes without saying that similar advantages are achieved when the present invention is adopted in such a heat exchanger which is known in the prior art.

As has been explained, according to the present invention, since indentations and projections are provided on the surface of a flat formed plate constituting a tube element at an end which corresponds to those on the formed plate to which it is to be bonded face-to-face, and the areas of the flat formed plate to which come in contact with the end plate are formed flat, sufficient passage area is assured in the end tube element. Also, at the same time, the flat formed plate and the end plate can be bonded without any gaps, thereby improving the strength.

Moreover, the problem of water collecting between the flat formed plate and the end plate are eliminated since the flat formed plate and the end plate are bonded together without any gaps. In particular, damage to the flat plate due to water becoming frozen and expanding is eliminated. As a result, a laminated heat exchanger with outstanding durability can be provided.

Furthermore, with the stage provided in the portion of the end plate where it comes into contact with the formed plate, the portions of the end plate project outwardly toward the flat formed plate and opposing the areas with indentations and projections on the surface of the formed plate being cutout so that the contacting portions are clear of the indentations and projections on the formed plate. Therefore, the surface of the end plate does not have to be changed in a complex manner in order to prevent interference with the indentations and projections in that area of the flat formed plate and, thus, the shape is simplified.

In addition, with the end plate provided so as to cover the entirety of the flat formed plate, it becomes unnecessary to plate the jig in contact with a clad surface when assembling and fixing the heat exchanger with a jig by forming the end plate as a member clad only on one side, and this will prevent degradation of the jig.

What is claimed is:

1. A laminated heat exchanger comprising:

a tube element assembly formed of a plurality of tube elements laminated alternately with fins over a plurality of levels, each of said tube elements including two formed plates bonded together to define a pair of tank portions and a passage portion providing fluid communication between said tank portions, said tank portions of adjacent tube elements being fluidly connected so as to define first and second tank groups extending in the direction of lamination, said first tank group being partitioned into a first tank block and a second tank block;

a heat exchanging fluid intake portion communicating with said first tank block;

a heat exchanging fluid outlet portion communicating with said second tank block, wherein one of said tube elements, of said plurality of tube elements, is located at an end of said tube element assembly and one of said formed plates of said one tube element is a flat formed plate which includes indentations and projections corresponding to indentations and projections of the other of said formed plates, and planar bonding areas are formed in said passage portion; and an end plate, positioned at said end of said tube element assembly, having a stage portion projecting toward said end of said tube element assembly and terminating in bonding surfaces which are bonded to said planar bonding areas of said flat formed plate only in areas which do not include said indentations and projections.

2. The laminated heat exchanger as claimed in claim 1, wherein said end plate covers said flat formed plate and is clad with brazing material only on surfaces opposing said flat formed plate.

3. A laminated heat exchanger comprising:

a tube element assembly formed of a plurality of tube elements laminated alternately with fins over a plurality of levels, each of said tube elements including two formed plates bonded together to define a pair of tank portions and a passage portion providing fluid communication between said tank portions, said tank portions of adjacent tube elements being fluidly connected so as to define first and second tank groups extending in the direction of lamination, said first tank group being partitioned into a first tank block and a second tank block;

a heat exchanging fluid intake portion communicating with said first tank block;

a heat exchanging fluid outlet portion communicating with said second tank block, wherein one of said plurality of tube elements is located at an end of said tube element assembly, and one of said formed plates of said one tube element is a flat formed plate, said flat formed plate is distended only to the same degree as the other formed plate of said one tube element is distended to form said passage portion, said flat formed plate includes projections and beads corresponding to projections and beads of said other of said formed plates, and planar bonding areas provided at a lower end and upper corners of said flat formed plate, and said planar bonding areas extend such that a portion thereof opposes distended portions of said other of said formed plates; and an end plate bonded to said flat formed plate.

4. The laminated heat exchanger as claimed in claim 3, wherein:

said end plate has an upper end which is bent toward said flat formed plate to form an upper bonding margin bonded to said planar bonding areas at said upper corners of said flat formed plate, said end plate has a lower end which is bent toward said flat formed plate to form a lower bonding margin bonded to said planar bonding area at said lower end of said flat formed plate, and said end plate is connected to said flat formed plate by fins.

5. The laminated heat exchanger as claimed in claim 4, wherein said end plate covers said flat formed plate and is clad with brazing material only on surfaces opposing said flat formed plate.

6. A heat exchanger comprising:

a tube element assembly defined by a plurality of tube elements laminated alternately with fins over a plurality of levels, each of said tube elements including two formed plates bonded together to define a pair of tank portions and a U-shaped passage portion providing fluid communication between said pair of tank portions;

a heat exchanging fluid intake portion provided at a first end of said tube element assembly;

a heat exchanging fluid outlet portion provided at said first end of said tube element assembly, wherein said tank portions of adjacent tube elements are fluidly connected so as to form two tank groups extending in a direction of lamination, one of said two tank groups is partitioned to define a first tank block and a second tank block, said tank portions of the other of said two tank groups are in fluid communication, and one of said formed plates of one of said plurality of tube elements, located at a second end of said tube element assembly, is a flat formed plate having planar bonding areas which extend into said passage portion, indentations and projections which correspond to indentations and projections of the other formed plate of said one tube element; and an end plate bonded to said flat formed plate at said planar bonding areas, end plate having a stage portion projecting toward said flat formed plate and connected to bonding surfaces which are formed so as to bond to said planar bonding areas of said flat formed plate which do not include said indentations and projections.

7. The laminated heat exchanger as claimed in claim 6, wherein said end plate covers said flat formed plate and is clad with brazing material only on surfaces opposing said flat formed plate.

8. A heat exchanger comprising:

a tube element assembly defined by a plurality of tube elements laminated alternately with fins over a plurality of levels, each of said tube elements including two formed plates bonded together to define a pair of tank portions and a U-shaped passage portion providing fluid communication between said pair of tank portions;

a heat exchanging fluid intake portion provided at a first end of said tube element assembly;

an heat exchanging fluid outlet portion provided at said first end of said tube element assembly, wherein said tank portions of adjacent tube elements are fluidly connected so as to form two tank groups extending in the direction of lamination, one of said tank groups is partitioned to define a first tank block and a second tank block, said tanks of the other of said tank groups are in fluid communication, one of said formed plates of one of said plurality of tube elements, located at a second end of said tube element assembly, is a flat formed plate having indentations and projections which correspond to indentations and projections of the other of said formed plates, said flat formed plate is distended only to the same degree as said other of said formed plates is distended to form said passage portion, said flat formed plate includes planar bonding areas provided at a lower end and upper corners of said flat formed plate, and said planar bonding areas extend such that a portion thereof opposes distended portions of said other of said formed plates; and an end plate bonded to said flat formed plate.

9. The laminated heat exchanger as claimed in claim 8, wherein:

said end plate has an upper end which is bent toward said flat formed plate to form an upper bonding margin bonded to said planar bonding areas at said upper corners of said flat formed plate, said end plate has a lower end which is bent toward said flat formed plate to form a lower bonding margin bonded to said planar bonding area at said lower end of said flat formed plate, and said end plate is connected to said flat formed plate by fins.

10. The laminated heat exchanger as claimed in claim 8, wherein said end plate covers said flat formed plate and is clad with brazing material only on surfaces opposing said flat formed plate.

11. A heat exchanger comprising:

a tube element assembly including a plurality of tube elements laminated alternately with fins provided between said tube elements over a plurality of levels, each of said tube elements including two formed plates bonded together to define a pair of tank portions and a U-shaped passage portion providing fluid communication between said tank portions, wherein said tank portions of adjacent tube elements are fluidly connected so as to form two tank groups extending in a direction of lamination, one of said tank groups is partitioned to define a first tank block and a second tank block, said tank portions of the other of said tank groups are in fluid communication, and one of said two formed plates of one of said tube elements, located at an end of said tube element assembly, is a flat formed plate having planar bonding areas which extend into said passage portion, and indentations and projections which correspond to indentations and projections of the other formed plate of said two formed plates;

a heat exchanging fluid intake portion connected to one of said tube elements of said first and second tank blocks;

a heat exchanging fluid outlet portion connected to one of said tube elements of the other of said first and second tank blocks; and an end plate bonded to said flat formed plate at said planar bonding areas, said end plate having a stage portion projecting toward said flat plate and terminating in bonding surfaces which are bonded to said planar bonding areas of said flat formed plate in locations which do not include indentations and projections of said flat formed plate.

12. The laminated heat exchanger as claimed in claim 11, wherein said end plate covers said flat formed plate and is clad with brazing material only on surfaces opposing said flat formed plate.

13. A heat exchanger comprising:

a tube element assembly formed of a plurality of tube elements laminated alternately with fins provided between said tube elements over a plurality of levels, each of said tube elements including two formed plates bonded together to define a pair of tank portions and a U-shaped passage portion providing fluid communication between said tank portions, wherein said tank portions of adjacent tube elements are fluidly connected so as to form two tank groups extending in the direction of lamination, one of said two tank groups is partitioned to define a first tank block and a second tank block, said tank portions of the other of said two tank groups are in fluid communication, one of said formed plates of one of said tube elements, located at an end of said tube element assembly, is a flat formed plate having indentations and projections which correspond to indentations and projections of the other of said formed plates of said one tube element, said flat formed plate is distended only to the same degree as said other formed plate is distended to form said passage portion, said flat formed plate includes planar bonding areas at a lower end and upper corners of said flat formed plate, and said planar bonding areas extend such that a portion thereof opposes distended portions of said other formed plate;

an end plate bonded to said flat formed plate;

a heat exchanging fluid intake portion connected to one of said tube elements of said first and second tank blocks; and a heat exchanging outlet portion connected to one of said tube elements of the other of said first and second tank blocks.

14. The laminated heat exchanger as claimed in claim 13, wherein:

said end plate has an upper end which is bent toward said flat formed plate to form an upper bonding margin bonded to said planar bonding areas at said upper corners of said flat formed plate, said end plate has a lower end which is bent toward said flat formed plate to form a lower bonding margin bonded to said planar bonding area at said lower end of said flat formed plate, and said end plate is connected to said flat formed plate by fins.

15. The laminated heat exchanger as claimed in claim 13, wherein said end plate covers said flat formed plate and is clad with brazing material only on surfaces opposing said flat formed plate.

* * * * *